US011483655B1

(12) United States Patent
O'Connell et al.

(10) Patent No.: US 11,483,655 B1
(45) Date of Patent: Oct. 25, 2022

(54) GAIN-ADAPTIVE ACTIVE NOISE REDUCTION (ANR) DEVICE

(71) Applicant: Bose Corporation, Framingham, MA (US)

(72) Inventors: Michael P. O'Connell, Northborough, MA (US); Joseph H. Cattell, Somerville, MA (US); Dale Ian McElhone, Marlborough, MA (US)

(73) Assignee: Bose Corporation, Framingham, MA (US)

( * ) Notice: Subject to any disclaimer, the term of this patent is extended or adjusted under 35 U.S.C. 154(b) by 23 days.

(21) Appl. No.: 17/218,559

(22) Filed: Mar. 31, 2021

(51) Int. Cl.
*H04R 3/02* (2006.01)
*H04R 1/10* (2006.01)

(52) U.S. Cl.
CPC ..... *H04R 3/02* (2013.01); *H04R 1/1016* (2013.01)

(58) Field of Classification Search
CPC ..... H04R 3/02; H04R 1/1016
See application file for complete search history.

(56) References Cited

U.S. PATENT DOCUMENTS

| | | | | |
|---|---|---|---|---|
| 8,737,636 | B2 | 5/2014 | Park et al. | |
| 8,909,524 | B2 * | 12/2014 | Stoltz | G10L 21/0216 704/215 |
| 9,053,697 | B2 | 6/2015 | Park et al. | |
| 9,361,872 | B2 | 6/2016 | Park et al. | |
| 9,659,558 | B2 | 5/2017 | Park et al. | |
| 10,347,233 | B2 | 7/2019 | Park et al. | |
| 10,462,551 | B1 | 10/2019 | Kemmerer et al. | |
| 10,580,398 | B2 | 3/2020 | Cattell et al. | |
| 10,937,408 | B2 * | 3/2021 | McCutcheon | G10K 11/17853 |
| 2016/0300562 | A1 | 10/2016 | Goldstein | |
| 2018/0286375 | A1 * | 10/2018 | Cattell | G10K 11/178 |
| 2019/0272814 | A1 | 9/2019 | Park et al. | |

FOREIGN PATENT DOCUMENTS

| | | | | |
|---|---|---|---|---|
| CN | 111800694 | A | 10/2020 | |
| DE | 112018000717 | T5 * | 1/2020 | G06F 1/3206 |
| EP | 3155610 | | 4/2017 | |
| WO | 2010/129241 | A1 | 11/2010 | |

OTHER PUBLICATIONS

International Search Report and Written Opinion from PCT/US2022/020134 dated Jun. 2, 2022, 17 pages.

* cited by examiner

*Primary Examiner* — David L Ton
(74) *Attorney, Agent, or Firm* — Hoffman Warnick LLC

(57) ABSTRACT

Various aspects include active noise reduction (ANR) devices and approaches, one approach including: receiving an input signal representing audio captured by a feedforward microphone of an ANR headphone; receiving an error signal representing audio captured by an error measurement sensor; generating an anti-noise signal configured to reduce a noise signal over a frequency range; and applying a gain to at least one of the input signal or the anti-noise signal over the frequency range based on the error signal, where the gain is calculated by: filtering the anti-noise signal over the frequency range to generate a filtered feedforward signal, and filtering the error signal over the frequency range to generate a filtered error signal; estimating a feedforward path contribution to the error signal; and determining the gain based on a correlation between the filtered error signal and the filtered feedforward signal with the assigned feedforward path contribution to the error signal.

21 Claims, 7 Drawing Sheets

GAIN-ADAPTIVE ACTIVE NOISE REDUCTION (ANR) DEVICE

TECHNICAL FIELD

This disclosure generally relates to audio devices. More particularly, the disclosure relates to active noise reduction (ANR) in audio devices.

BACKGROUND

ANR devices can utilize one or more digital signal processors (DSPs) for implementing various signal flow topologies. Examples of such DSPs are described in U.S. Pat. Nos. 10,580,398; 8,073,150; and 8,073,151, each of which is incorporated herein by reference in its entirety.

Conventional feed forward (FF) ANR devices that use fixed controllers (i.e., having a fixed set of filter coefficients) have numerous benefits. For example, these fixed controller-type devices can quickly respond to changes in noise conditions without requiring excessive processing capabilities and/or power consumption. These conventional fixed controller-type ANR devices attempt to approximate an average FF noise response for a group of users. However, such devices can also suffer from performance degradation caused by variations in fit and use by distinct users. In certain form factors, such as in-ear audio devices, variations between users can be significant, thereby contributing to unacceptable performance degradation within a given group of users.

SUMMARY

All examples and features mentioned below can be combined in any technically possible way.

Various aspects include active noise reduction (ANR) devices and related audio devices and approaches for active noise reduction (ANR). In certain cases, the ANR device is gain-adaptive.

In some particular aspects, a method includes: receiving an input signal representing audio captured by a feedforward microphone of an active noise reduction (ANR) headphone; receiving an error signal representing audio captured by an error measurement sensor; generating an anti-noise signal configured to reduce a noise signal over a frequency range; and applying a gain to at least one of the input signal or the anti-noise signal over the frequency range based on the error signal, where the gain is calculated by: filtering the anti-noise signal over the frequency range to generate a filtered feedforward signal, and filtering the error signal over the frequency range to generate a filtered error signal; estimating a feedforward path contribution to the error signal; and determining the gain based on a correlation between the filtered error signal and the filtered feedforward signal with the assigned feedforward path contribution to the error signal.

In some particular aspects, an active noise reduction (ANR) device includes: a feedforward input for receiving an input signal representing audio captured by a feedforward microphone of an active noise reduction (ANR) headphone; a gain control block for receiving an error signal representing audio captured by an error measurement sensor; and an ANR filter for generating an anti-noise signal configured to reduce a noise signal over a frequency range, where the gain control block is configured to apply a gain to at least one of the input signal or the anti-noise signal over the frequency range based on the error signal, where the gain control block calculates the gain by: applying a bandpass filter to the anti-noise signal over the frequency range to generate a filtered feedforward signal, and applying the bandpass filter to the error signal over the frequency range to generate a filtered error signal; estimating a feedforward path contribution to the error signal; and determining the gain based on a correlation between the filtered error signal and the filtered feedforward signal with the assigned feedforward path contribution to the error signal.

Implementations may include one of the following features, or any combination thereof.

In certain implementations, estimating the feedforward path contribution to the error signal is performed with an estimator filter prior to determining the gain.

In particular cases, the estimate of the feedforward path contribution to the error signal is calculated using an estimated system transfer function ($G_{sd}$) applied to the anti-noise signal, where the anti-noise signal is generated by an ANR filter.

In some aspects, the estimated system transfer function ($G_{sd}$) is an estimate based on measured transfer function components.

In certain implementations, the filtering is performed using a bandpass filter.

In particular cases, the bandpass filter is applied across a frequency range that is predetermined and is equal to approximately 50 Hertz (Hz) to approximately 800 Hz.

In some aspects, a phase of the anti-noise signal and the error signal varies by less than a threshold.

In particular implementations, the method further includes modifying the gain based on at least one of: an overload control adjustment, a self-voice detection adjustment, a music playback mode adjustment, an aware mode adjustment, or a communication mode adjustment.

In certain cases, the anti-noise signal is generated by an ANR filter having a fixed set of filter coefficients for generating the anti-noise signal.

In some aspects, the ANR filter has a voltage limit for generating the anti-noise signal.

In particular cases, the gain has an upper limit based on an expected value of the input signal or the error signal.

In certain implementations, the method further includes: in response to the determined gain exceeding a threshold attributed to a fit of the ANR headphone, sending an indicator to a user of the ANR headphone to adjust the fit.

In some aspects, the method further includes: in response to the determined gain deviating from a threshold attributed to on-head usage of the ANR headphone, at least one of: powering down the ANR headphone or switching the ANR headphone to a standby mode.

In particular cases, the gain is calculated by a gain control block configured to calculate the gain over only the frequency range.

In some aspects, the gain control block down-samples the anti-noise signal and the error signal to mitigate power usage in the ANR headphone.

In particular cases, the error measurement sensor includes a feedback microphone at the ANR headphone, and the method further includes: adjusting, at the ANR filter, the gain based on a feedback signal detected by the feedback microphone.

In certain implementations, the ANR headphone is an in-ear audio device or an around-ear audio device.

In some cases, the ANR device further includes: an estimator filter configured to estimate the feedforward path contribution to the filtered error signal prior to determining the gain, where the estimate of the feedforward path contribution to the filtered error signal is calculated using an estimated system transfer function (Gsd) applied to the anti-noise signal generated by the ANR filter, and the magnitude of the system transfer function (Gsd) is an estimate based on measured transfer function components.

In particular implementations, the gain control block is configured to calculate the gain over only the frequency range and down-sample the anti-noise signal and the error signal to mitigate power usage.

In some aspects, the ANR device further includes a processor coupled with the ANR filter, the processor configured to perform at least one of: a) in response to the determined gain exceeding a threshold attributed to a fit of the ANR headphone, sending an indicator to a user of the ANR headphone to adjust the fit, or b) in response to the determined gain deviating from a threshold attributed to on-head usage of the ANR headphone, at least one of: powering down the ANR headphone or switching the ANR headphone to a standby mode.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

Figure 1:
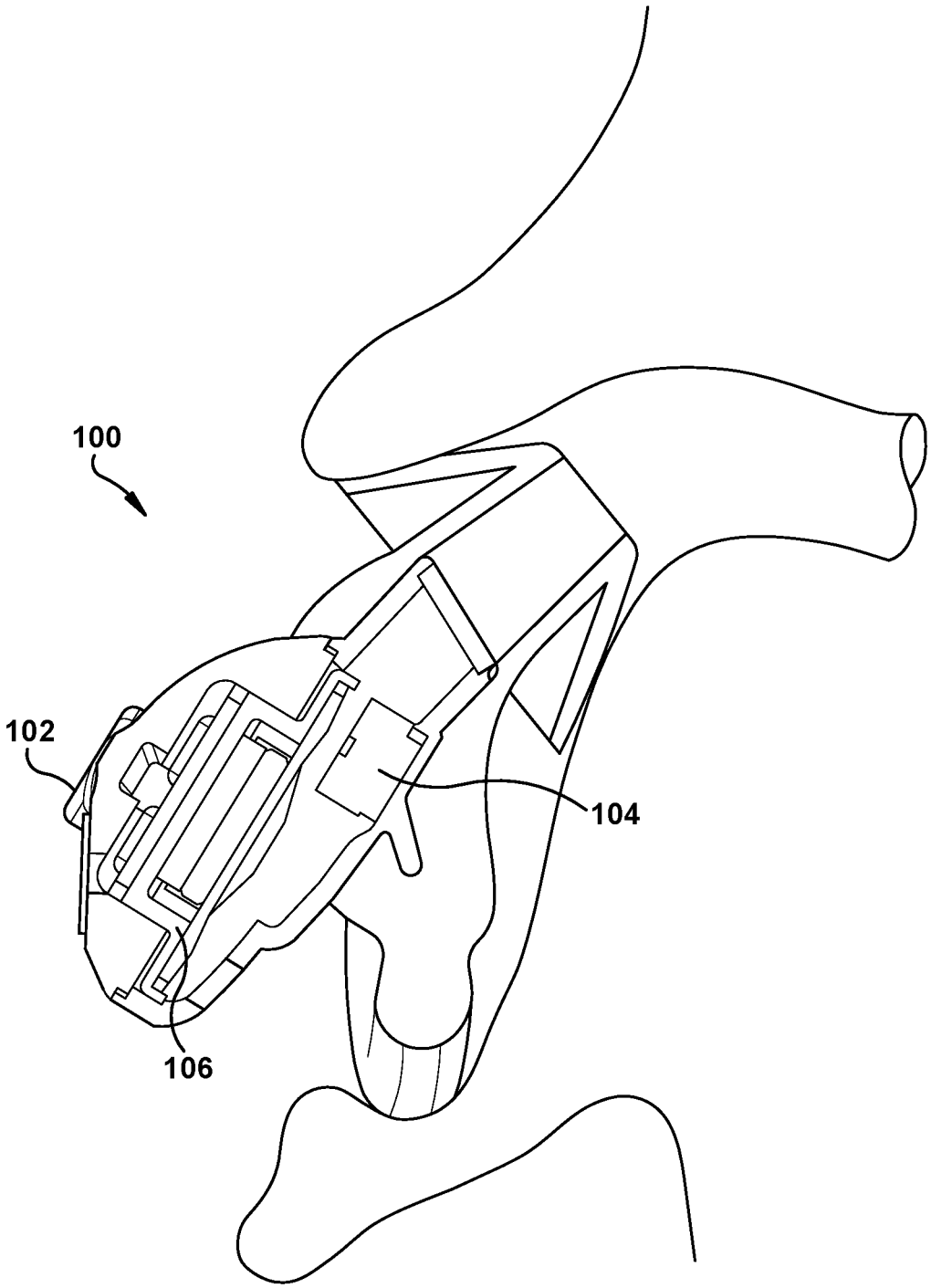
FIG. 1 shows an in-ear active noise reduction (ANR) headphone according to various implementations.

It is noted that the drawings of the various implementations are not necessarily to scale. The drawings are intended to depict only typical aspects of the disclosure, and therefore should not be considered as limiting the scope of the invention. In the drawings, like numbering represents like elements between the drawings.

DETAILED DESCRIPTION

As noted herein, various aspects of the disclosure generally relate to active noise reduction (ANR) in audio devices. More particularly, aspects of the disclosure relate to a gain-adaptive approach for ANR in audio devices.

Commonly labeled components in the FIGURES are considered to be substantially equivalent components for the purposes of illustration, and redundant discussion of those components is omitted for clarity.

As noted herein, conventional fixed feedforward controller-type ANR devices can suffer from performance degradation caused by variations in fit and use by distinct users. For example, in certain form factors (e.g., in-ear audio devices or on-ear audio devices), variations between users can contribute to unacceptable performance degradation within a given group of users.

Relative to conventional ANR devices and approaches, various implementations include ANR devices and approaches for applying a gain to an input signal and/or an anti-noise signal over a frequency range that improves noise reduction for a group of users (e.g., across varying fits). In particular implementations, the ANR device assigns a feedforward (FF) path contribution to a (filtered) input signal, and calculates the gain using a correlation between a filtered error signal and the filtered input signal, accounting for the assigned feedforward (FF) path contribution.

An active noise reduction (ANR) device can include a configurable digital signal processor (DSP), which can be used for implementing various signal flow topologies and filter configurations. Examples of such DSPs are described in U.S. Pat. Nos. 10,580,398, 8,073,150 and 8,073,151, which are incorporated herein by reference in their entirety. U.S. Pat. No. 9,082,388, also incorporated herein by reference in its entirety, describes an acoustic implementation of an in-ear active noise reducing (ANR) headphone, as shown in FIG. 1. This headphone 100 includes a feedforward microphone 102, a feedback microphone 104, an output transducer 106 (which may also be referred to as an electroacoustic transducer or acoustic transducer), and a noise reduction circuit (not shown) coupled to both microphones 102, 104 and the output transducer 106 to provide anti-noise signals to the output transducer 106 based on the signals detected at both microphones 102, 104. An additional input (not shown in FIG. 1) to the circuit provides additional audio signals, such as music or communication signals, for playback over the output transducer 106 independently of the noise reduction signals.

The term headphone, which is interchangeably used herein with the term headset, includes various types of personal acoustic devices such as in-ear, around-ear or over-the-ear headsets, earphones, and hearing aids. The headsets or headphones can include an earbud or ear cup for each ear. The earbuds or ear cups may be physically tethered to each other, for example, by a cord, an over-the-head bridge or headband, or a behind-the-head retaining structure. In some implementations, the earbuds or ear cups of a headphone may be connected to one another via a wireless link. In certain implementations, the headphone(s) include an on-ear, over-ear, around-ear and/or over-head mount or frame. In some cases, the headphone(s) rest on the ear of the user, in one or more locations. In particular implementations, the ANR headphone 100 (FIG. 1) is a headphone that provides an acoustic seal in, on, or around the user's ear and/or ear canal entrance. In certain of these cases, the ANR headphone is an in-ear audio device, on-ear audio device, or an around-ear audio device.

Various signal flow topologies can be implemented in an ANR device to enable functionalities such as audio equalization, feedback noise cancellation, feedforward noise cancellation, etc. For example, as shown in the example block diagram of an ANR device 200 in FIG. 2, the signal flow topologies can include a feedforward noise reduction path 110 that drives the output transducer 106 to generate an anti-noise signal (using, for example, a feedforward compensator 112) to reduce the effects of a noise signal picked up by the feedforward microphone 102. In another example, the signal flow topologies can include a feedback noise reduction path 114 that drives the output transducer 106 to generate an anti-noise signal (using, for example, a feedback compensator 116) to reduce the effects of a noise signal picked up by the feedback microphone 104. The signal flow topologies can also include an audio path 118 that includes circuitry (e.g., equalizer 120) for processing input audio signals 108 such as music or communication signals, for playback over the output transducer 106.

In various implementations, audio playback (e.g., from two-way communication such as telephone mode, and/or music/entertainment playback) can affect the desired behavior of gain control in the ANR device. As noted herein, approaches for gain control during audio playback can include adjusting adaption rate parameters, freezing (pausing) adaptive gain in a given state, and/or returning to a default (e.g., nominal) gain value. These approaches can also be used when the ANR device is operating in a hearthrough or "aware" mode, whereby ambient acoustic signals (e.g., noise, other users' voices, etc.) are played back through the device transducers as though certain ANR functions were disabled or otherwise mitigated. It is understood that in a number of operating modes, including in hearthrough or "aware" mode, the feedback loop remains active to reduce the acoustic "occlusion" effect produced by detection of the user's own voice.

During most operating conditions, the acoustic noise energy that the ANR device attempts to reduce is small enough to keep the system hardware within capacity. However, in some circumstances, discrete acoustic signals or low frequency pressure disturbances (e.g., loud pops, bangs, door slams, etc.) picked up by the feedforward or feedback microphones can cause the noise reduction circuitry to overrun the capacity of the electronics or the output transducer 106 in trying to reduce the resulting noise, thereby creating audible artifacts which may be deemed objectionable by some users. These conditions, which are referred to herein as overload conditions, can be manifested by, for example, clipping of amplifiers, hard excursion limits of acoustic drivers or transducers, or levels of excursion that cause sufficient change in the acoustics response so as to cause oscillation. The problem of overload conditions can be particularly significant in small form-factor ANR devices such as in-ear headphones. For example, in order to compensate for low frequency pressure disturbances (e.g., a bus going over a pothole, a door slam, or the sound of an airplane taking off), the feedforward compensator 112 may generate a signal that would require the acoustic transducer 106 to exceed the corresponding physical excursion limit. Due to acoustic leaks, the excursion or driver displacement to create a given pressure typically increases with decreasing frequencies. For example, a particular acoustic transducer may need to be displaced 1 mm to generate an anti-noise signal for a 100 Hz noise, 2 mm to generate an anti-noise signal for a 50 Hz noise, and so on. Many acoustic transducers, particularly small transducers used in small form-factor ANR devices are physically incapable of producing such large displacements. In such cases, the demand of the high displacement by a compensator can cause the transducer to generate sounds that cause audible artifacts, which may contribute to an objectionable user experience. The audible artifacts can include oscillations, potentially objectionable transient sounds (e.g., "thuds," "cracks," "pops," or "clicks"), or crackling/buzzing sounds.

Figure 2:
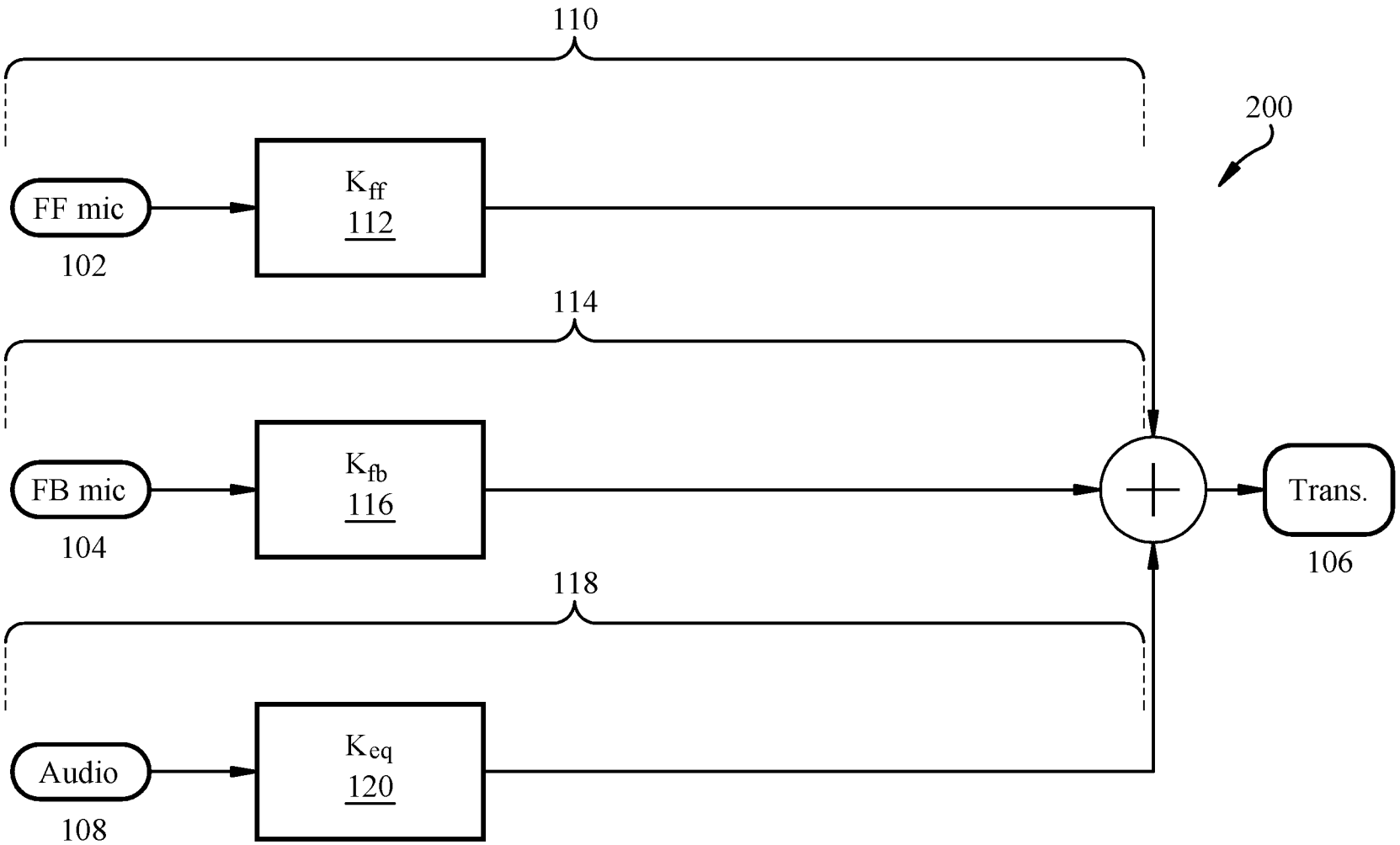
FIG. 2 is a block diagram of an ANR device.
Figure 3:
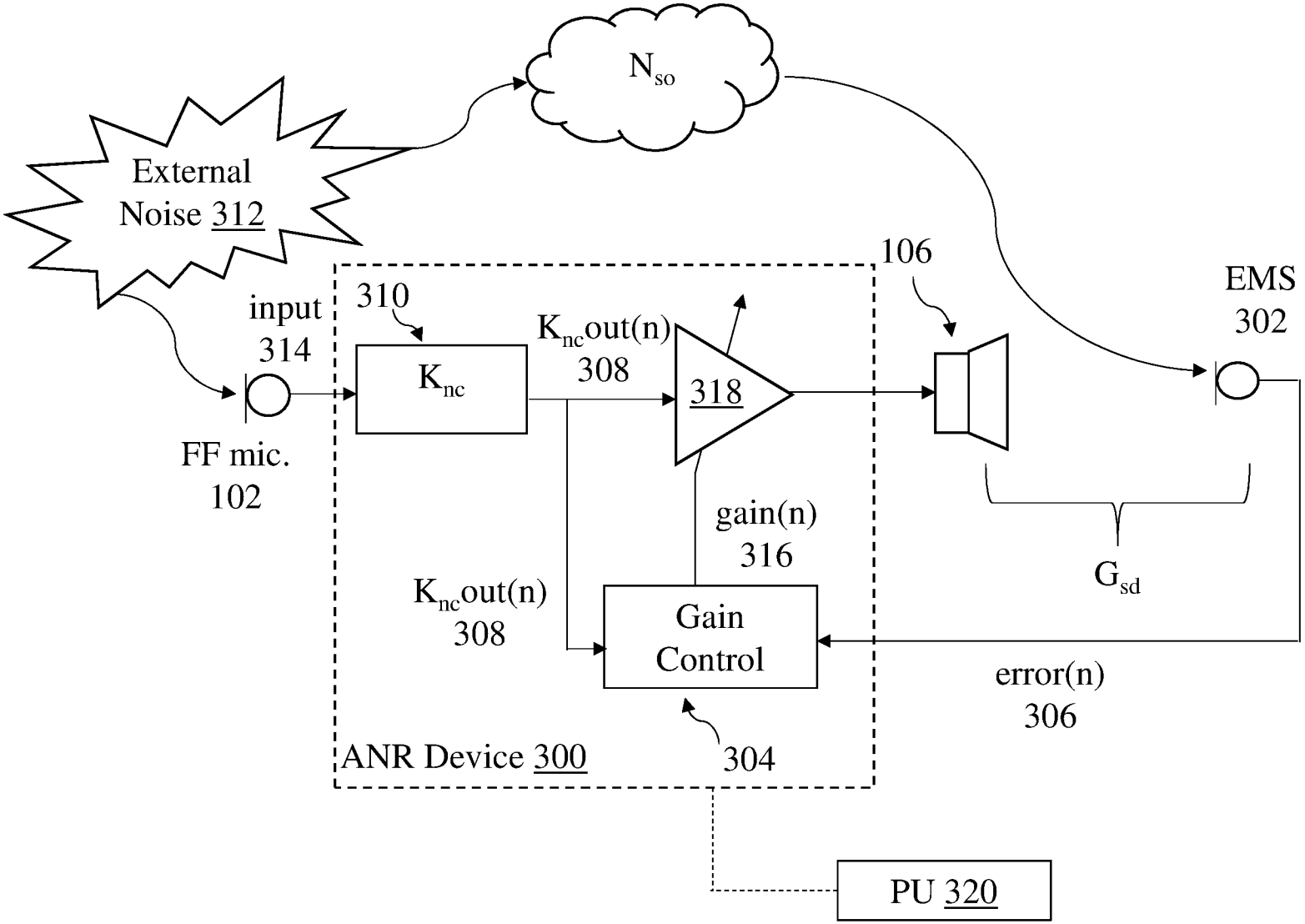
FIG. 3 is a block diagram of portions of an ANR device in a headphone according to various implementations.

FIG. 3 illustrates an example ANR device 300 according to various disclosed implementations. As described herein, the ANR device 300 can be implemented in one or more of the noise reduction paths illustrated in FIG. 2, e.g., the feedforward noise reduction path 110. Additionally, while not illustrated in FIG. 3, the ANR device 300 can be implemented in systems with multiple feedforward microphones (e.g., feedforward microphone 102), e.g., in one or more feedforward noise reduction paths. As described herein, the ANR device 300 is configured to control the gain applied to the input signal and/or the anti-noise signal over a frequency range to enhance performance. The ANR device 300 is configured to perform the functions described herein using fixed controllers (i.e., a fixed set of filter coefficients), thereby mitigating processing and/or power consumption.

In various implementations, the ANR device 300 is connected with a feedforward microphone 102 and an electro-acoustic transducer 106 as described with respect to FIG. 2. In certain cases, the ANR device 300 is connected with an error measurement sensor (EMS) 302 that is configured to detect an audio signal from in or around the user's ear canal. In certain cases, the EMS 302 includes one or more microphones. In particular cases, the EMS 302 includes the feedback microphone 104 (FIG. 2). In various implementations, external noise is also detected at EMS 302 (noise signal path $N_{so}$ shown).

The ANR device 300 also includes a gain control block 304 for receiving an error signal 306 representing the audio captured by EMS 302. The gain control block 304 is also configured to receive an anti-noise signal ($K_{nc}$out) 308 from an ANR filter 310. In various implementations, the ANR filter 310 includes a feedforward compensator (or, controller) similar to $K_{ff}$ 112 shown and illustrated in FIG. 2. In certain cases, the feedforward compensator will ideally have a frequency response of—$N_{so}/G_{sd}$ (which is not always practically achieved). As noted herein, the feedforward compensator filters the input signal 314 received at the external feed forward microphone 102 such that when the filtered signal (anti-noise signal 308) is passed through the output transducer 106 it cancels the acoustic signal at the ear (or at the error sensor such as EMS 302, or at a feedback microphone).

The ANR filter 310 may be implemented as a finite-impulse-response (FIR) filter, as an infinite-impulse-response (IIR) filter, or as a series of two or more FIR and/or IIR filters. The ANR filter 310 has a feedforward input for receiving an input signal 314 that represents audio captured by the feedforward microphone 102 (e.g., external noise 312). The ANR filter 310 generates an anti-noise signal 308 that is configured to reduce a noise signal (e.g., external noise 312) over a frequency range, e.g., a defined frequency range. In various implementations, the ANR filter 310 has a fixed set of filter coefficients for generating the anti-noise signal 308. In certain cases, the ANR filter 310 has a voltage or magnitude limit for generating the anti-noise signal 308.

As described herein, the gain control block 304 is configured to apply a gain 316 to the input signal 314 and/or the anti-noise signal 308 over the frequency range, based on the error signal 306 and the anti-noise signal 308. In various implementations, the gain control block 304 is configured to apply the gain 316 by controlling a signal input to a gain control element 318. Gain control element 318 can be configured to amplify and/or attenuate the output of the ANR filter 310 according to filter gain 316. The filter gain 316 can be applied as a linear or logarithmic gain factor, or a linear or logarithmic change to a gain factor. In some cases, the gain control element 318 is implemented as a multiplier (e.g., within the processor 320), as a variable gain amplifier (VGA) in the feedforward signal flow path to the transducer 106, or within the signal flow path of feedforward microphone 102.

Figure 4:
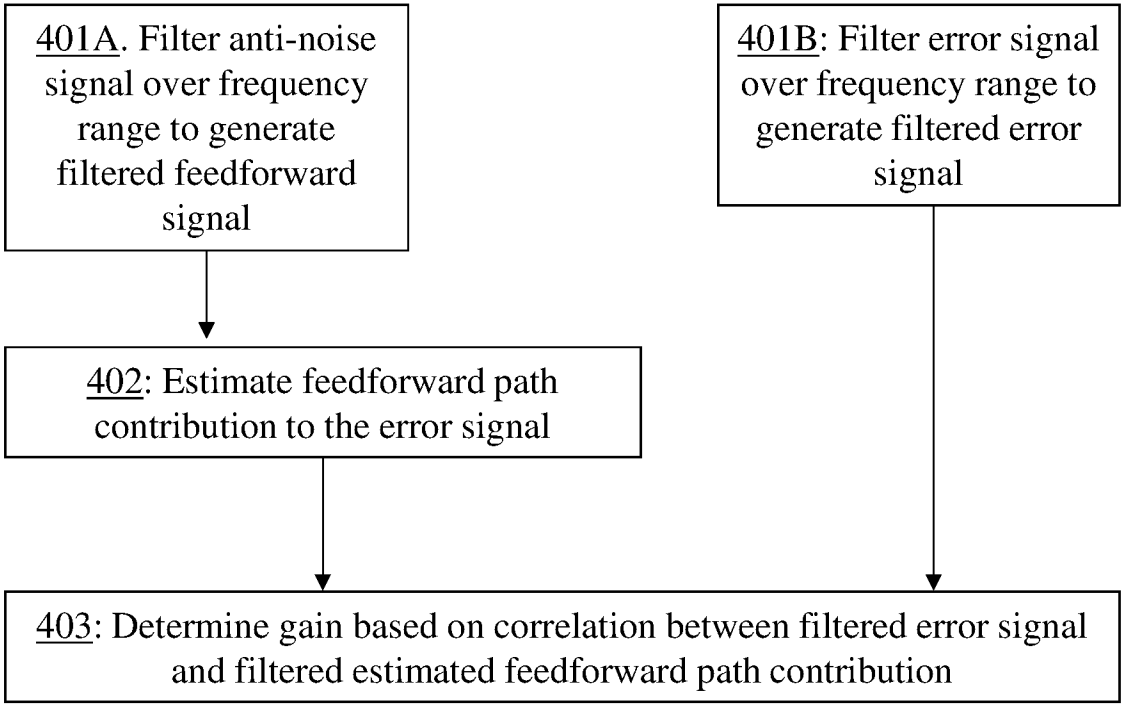
FIG. 4 is a flow diagram illustrating processes according to various implementations.
Figure 5:
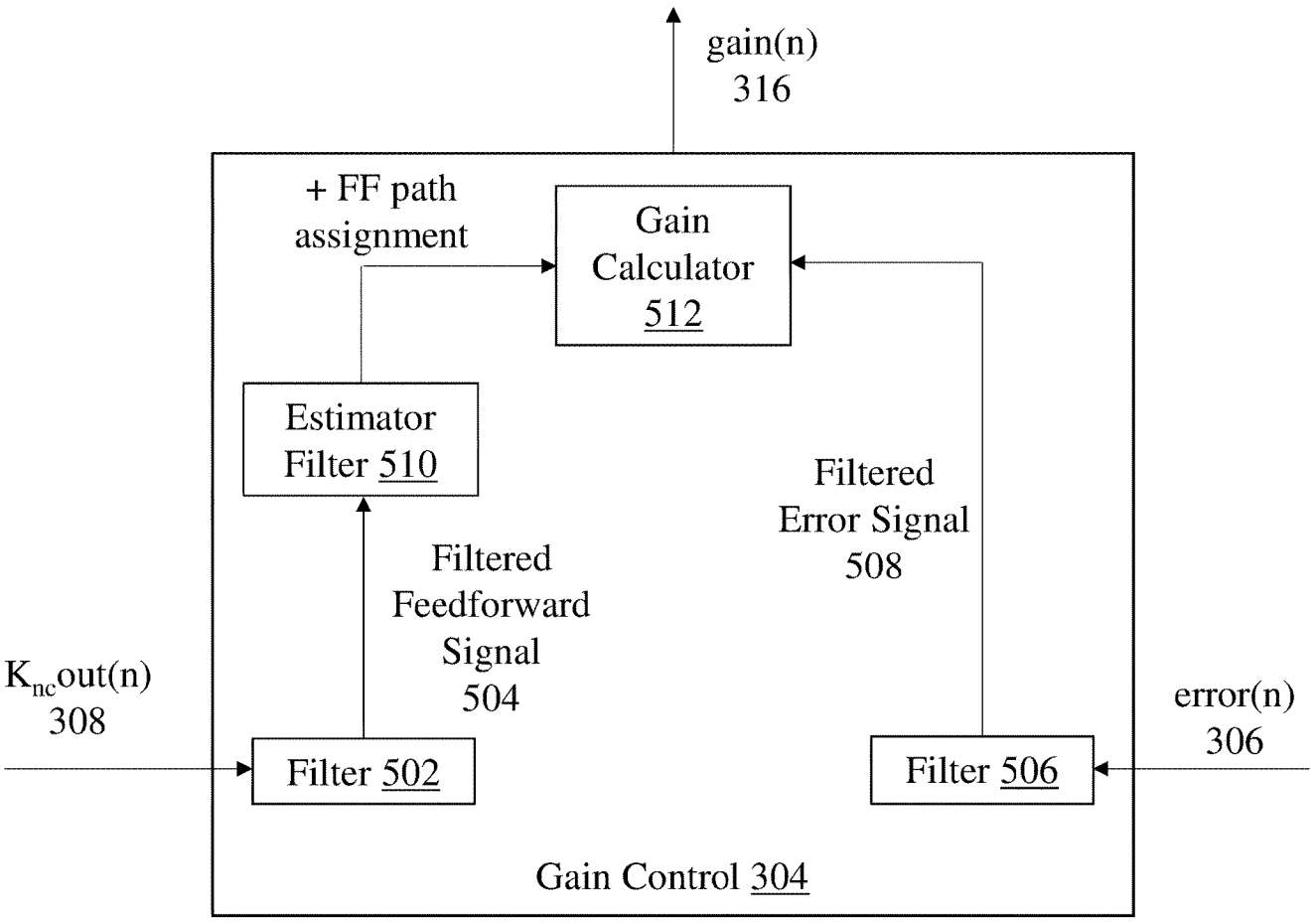
FIG. 5 is a block diagram of a gain control block according to various implementations.

FIG. 4 shows a flow diagram illustrating processes performed by the gain control block 304 in calculating the gain 316 (FIG. 3). FIG. 5 illustrates sub-components in the gain control block 304 for performing the processes illustrated in FIG. 4. In various implementations, the gain control block 304 is configured to:

Process 401A: Filter (with filter 502, FIG. 5) the anti-noise signal 308 from the ANR filter 310 over a frequency range to generate a filtered feedforward signal 504; and Process 401B: Filter (with filter 506, FIG. 5) the error signal 306 over the frequency range to generate a filtered error signal 508. In certain implementations, the anti-noise signal 308 and error signal 306 are filtered over the frequency range simultaneously, or approximately simultaneously. In other implementations, processes 401A and 401B are performed sequentially, in any order. As noted herein, in various implementations, the anti-noise signal 308 and error signal 306 are filtered over the same frequency range. In certain implementations, filters 502 and 506 are the same or substantially identical filter components. In other cases, filters 502 and 506 are distinct components. In various implementations, at least one filter 502, 506 includes a bandpass filter. In particular cases, both filters 502 and 506 include a bandpass filter. In some specific cases, the bandpass filter is applied across a frequency range that is predetermined, e.g., based on the design of the headphone 100. In certain cases, the frequency range is predetermined based on the type of headphone 100, e.g., in-ear as compared with on-ear. According to some example implementations, the frequency range is equal to approximately 50 Hertz (Hz) to approximately 800 Hz. In various implementations, the frequency range of the bandpass filter(s) is determined by the phase variation as a function of the frequency of $G_{sd}$ measured on a sample data set (e.g., a sample of (n) headsets and users). In certain cases, the frequency threshold(s)/range(s) for bandpass filtering are based on a standard deviation correlating to that data set, and/or a minimum/maximum correlating to that data set. In some cases, the phases of the anti-noise signal 308 and the error signal 306 vary by less than a threshold, e.g., +/−90 degrees from a nominal response. In certain cases, the phases of the anti-noise signal 308 and the error signal 306 vary by significantly less than +/−90 degrees from the nominal response. The frequency range and phase variation can be based on a statistical mean and/or median from a set of test subjects, and can be stored for application by filters 502 and 506. The frequency range and phase variation can also be configured to be updated according to changes and/or additions in test subject data.

Following filtering (processes 401A, B), in process 402: the control block 304 performs:

Process 402: Estimate (with estimator filter 510, also referred to as a cancelation path estimator filter or a plant estimator filter) a feedforward path contribution to the error signal 306. That is, the cancelation path estimator filter 510 (FIG. 5) estimates the signal that will arrive at the EMS 302 based on the anti-noise signal 308 that passes through the gain control element 318 and is output at transducer 106. According to various implementations, assigning the feedforward path contribution to the error signal 306 is performed using an estimated system transfer function ($G_{sd}$) that is applied to the anti-noise signal 308 (as generated by ANR filter 310). As is known in the art, the estimated system transfer function ($G_{sd}$) is an estimate based on measured transfer function components. That is, as described herein, the gain control block 304 (e.g., at cancelation path estimator filter 510) is configured to estimate the system transfer function ($G_{sd}$), which is a quantity that is calculated based upon measured transfer function components. In a laboratory setting, this system transfer function ($G_{sd}$) can be measured by computing a transfer function between the driver signal (voltage) and feedback microphone signal (voltage) in the absence of noise or other sound, that is, without ANR functionality running. However, in practice, it is difficult to directly measure the system transfer function ($G_{sd}$) in a wearable audio device because ANR functionality is often employed. As such, the system transfer function ($G_{sd}$) described herein is noted as an estimated function that is based upon other measured transfer function components. This "system transfer function ($G_{sd}$)" differs from measured transfer function values, and is denoted as such herein.

Process 403: Determine the gain (e.g., with gain calculator 512, FIG. 5) based on a correlation between the filtered error signal 508 and the filtered feedforward signal 504 with the assigned feedforward path contribution to the error signal (+FF path assignment).

As noted herein, in various implementations, the gain calculator 512 is configured to determine the gain 316 based on the correlation between the filtered error signal 508 and the filtered feedforward signal 504 with the assigned feedforward path contribution (+FF path). In certain cases, the gain calculator 512 includes or otherwise applies a least mean squares (LMS) algorithm, to update the gain over time. In certain cases, the gain calculator 512 iteratively updates the gain, e.g., computing a delta (or, increment) that is added to the previous gain value. Update types can include standard, normalized, sign, etc. In certain examples, the gain formula is represented by $g(n+1)=g(n)+F(u(n),e(n))$, where $u(n)$ is the feedforward path contribution (+FF path) and $e(n)$ is the filtered error signal 508. Certain examples of LMS filtering are disclosed in Melvin Hick's lecture (Lecture 5) on "Variants of the LMS algorithm" published in 2017, which is incorporated by reference in its entirety and can be accessed at: https://www.cs.tut.fi/~tabus/course/ASP/SGN2206LectureNew5.pdf.

In certain implementations, the gain 316 is calculated over only the frequency range, e.g., the predetermined frequency range between approximately 50 Hertz (Hz) to approximately 800 Hz. In some cases, the gain control block 304 down-samples the anti-noise signal 308 and the error signal 306 to mitigate power usage in the headphone 100. That is, the gain control block 304 is configured in various implementations to process the anti-noise signal 308 and error signal 306 at a lower rate than the sampling rate, conserving resources (e.g., power) for later use.

As noted herein, the gain 316 may have an upper limit (maximum). This upper limit can be based on physical and/or system limitations in the ANR headphone, e.g., system stability constraints and/or in order to control undesirable system behaviors if the FF microphone 102 is blocked or damaged. In certain implementations, the gain control block 304 is configured to modify the gain 316 based on an overload control adjustment, e.g., to address an overload event such as those described herein. For example, in practice, the voltage applied to the driver 106 or the mechanical displacement of the driver 106 all have maximum magnitudes which cannot be exceeded without causing "clipping" or other distortions (described herein). In order to prevent such "clipping" or other distortions, the gain control block 304 can be configured to limit or otherwise reduce the gain 316 in response to detecting that the feedforward anti-noise signal 308 and/or the total output signal sent to the driver 106 exceeds a threshold (e.g., a threshold correlated with clipping and/or distortion). In these cases, the gain control block 304 can be configured to compare the feedforward anti-noise signal 308 and/or the calculated output signal to the driver 106 (based on calculated gain 316 and feedforward anti-noise signal 308) with a threshold before assigning the gain 316 to the gain control element 318. In additional or alternative cases, the gain control block 304 can include an independent gain control element/element(s) for adjusting to detected overload events. In certain of these cases, the gain control block 304 applies an additional (distinct) gain to the gain control element 318 in response to determining that the feedforward anti-noise signal 308 and/or the calculated output signal deviates from a threshold that indicates an overload event. In some cases, the gain control block 304 is configured to run the overload gain control in parallel with the primary gain control functions described herein, and in certain cases, can disable or suspend the primary gain control functions in response to detecting an overload event (enabling control of the gain control element 318 strictly with the overload gain control topology). Examples of such parallel compensation are described in U.S. Pat. No. 10,580,398 (previously incorporated by reference herein).

In certain implementations, as shown in phantom in FIG. 3, the gain control block 304 and/or ANR device 300 include a processor (PU) 320, or are otherwise coupled with a processor 320 (e.g., a central processor in the headphone 100) that is configured to control additional device functions based on the determined gain 316. For example, in certain cases, the processor 320 is configured to perform functions in response to the determined gain 316 deviating from, or exceeding certain thresholds. In a particular example, in response to the determined gain exceeding a threshold attributed to a fit of the ANR headphone 100, the processor 320 is configured to send an indicator to the user of the ANR headphone 100 to adjust the fit. For example, in certain cases, the value of the gain indicates that an undesirable amount of acoustic leakage is present at the seal around the user's ear canal entrance. In these cases, it may be beneficial to have the user adjust the fit to better seal the ear canal entrance. In particular case, the processor 320 is configured to send an indicator of a fit issue to the user, e.g., via any interface on or connected with the ANR headphone 100 (e.g., a tactile interface indicator such as a vibration, a message in a display on a connected smart device, or an audio notification such as an output at driver 106).

In still further implementations, in response to the determined gain 316 deviating from a threshold that is attributed to on-head usage of the ANR headphone 100, the processor 320 can be configured to power down the headphone 100 and/or switch the ANR headphone 100 to standby mode. For example, the threshold attributed to on-head usage can indicate that the ANR headphone 100 is on the user's head. In response to the gain 316 deviating from that threshold, the processor 320 concludes that the ANR headphone 100 is no longer on the user's head. In these cases, the processor 320 can switch the headphone 100 to one or more standby modes (e.g., progressively), and in some cases (e.g., after a waiting period), powers down the ANR headphone 100. In additional cases, the processor 320 can be configured to take action (e.g., resuming playback, or activating an ANR filter) in response to detecting whether the ANR headphone 100 is on the user's head, e.g., after detecting an off-head event. Additional examples of components and functions of a processor (e.g., processor 320), including actions that can be performed in response to detecting changes from on-head to off-head, and vice versa, can be found in U.S. Pat. No. 10,462,551, which is incorporated by reference in its entirety.

In other cases, the processor 320 can store custom feedback and/or feedforward ANR filters for application by distinct users. In these cases, stored gain values or ranges are attributed to particular users and can be used to determine whether the particular user(s) is currently wearing the ANR headphone 100. In response to the calculated gain 316 corresponding with a stored gain value and/or range, the processor 320 updates one or more ANR settings for the detected user.

In certain additional implementations, the gain control block 304 is configured to modify the gain 316 based on one or more operating modes and/or functions of the headphone 100, including, e.g., a self-voice detection adjustment, a music playback mode adjustment, an aware mode adjustment, or a communication mode adjustment. For example, a processor (e.g., PU 320, FIG. 3) can be configured to detect operating modes and/or functions of the headphone 100 and enable a corresponding gain control adjustment. In some example implementations, in response to detecting that the user is talking (e.g., with conventional self-speech detection, such as described in U.S. Pat. No. 9,620,142, which is incorporated by reference in its entirety), the processor (e.g., PU 320) pauses or otherwise disables the gain control functions of the ANR device 300 (e.g., disabling or pausing the gain control block 304). In still further example implementations, in response to detecting that music playback is engaged (e.g., via audio playback controller and/or circuitry coupled with processor 320), the processor modulates the gain update (e.g., via gain control block 304) based on the music playback level and/or detected external noise level. In additional example implementations, in response to detecting that aware mode is enabled (e.g., via processor 320 controls, whereby ambient acoustic signals such as noise, other users' voices, etc., are played back through the device transducer(s) 106 as though ANR functions were disabled or otherwise mitigated), the processor (e.g., PU 320) pauses or otherwise disables the gain control functions of the ANR device 300 (e.g., disabling or pausing the gain control block 304), and/or reverts to a nominal gain (e.g., 1.0). In still further example implementations, in response to detecting that a communication mode is engaged (e.g., via WiFi, telephone, etc. controller and/or circuitry coupled with processor 320), the processor pauses or otherwise disables the gain control functions of the ANR device 300 (e.g., disabling or pausing the gain control block 304), and/or reverts to a nominal gain (e.g., 1.0).

Figure 6:
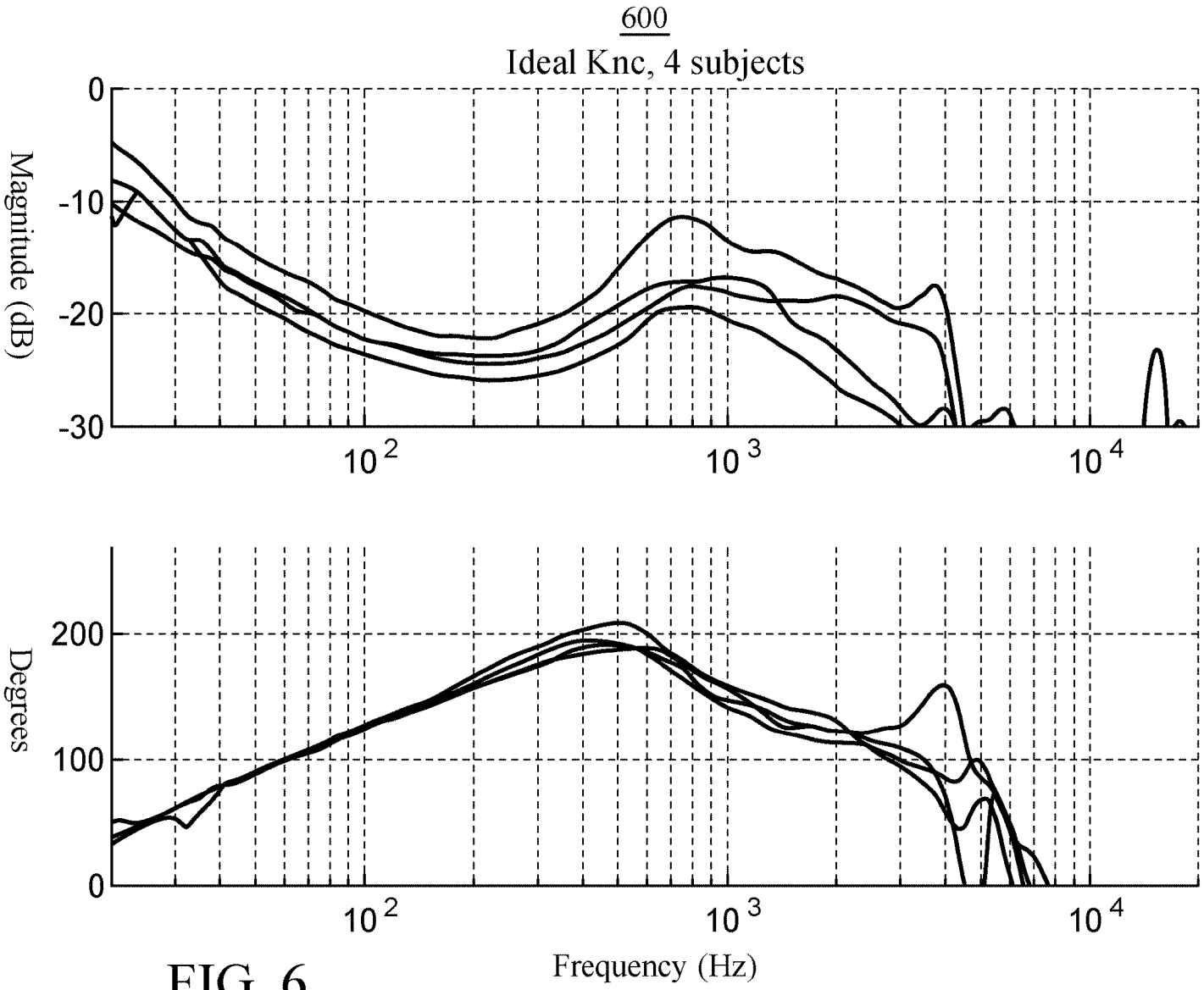
FIG. 6 is a graphical depiction illustrating example frequency and magnitude responses for an ANR device according to various implementations.

FIG. 6 is a graph 600 illustrating one example depiction of ideal magnitude (dB) and frequency responses for an ANR filter for four distinct users (subjects). As shown in this example, the ideal response of these users have similar shapes across a particular frequency range, e.g., approximately 50 Hz to approximate 800 Hz. The similarity in response shapes indicates that with a gain adjustment, the magnitude curves would overlay (or approximately overlay) one another. The phases of this group of example users is also tightly grouped. As such, an ANR device similar to ANR device 300 shown and described herein can effectively use a gain adjustment to align the magnitude of the system response across a group of users, thereby mitigating undesirable variation due to differences in device fit.

Figure 7:
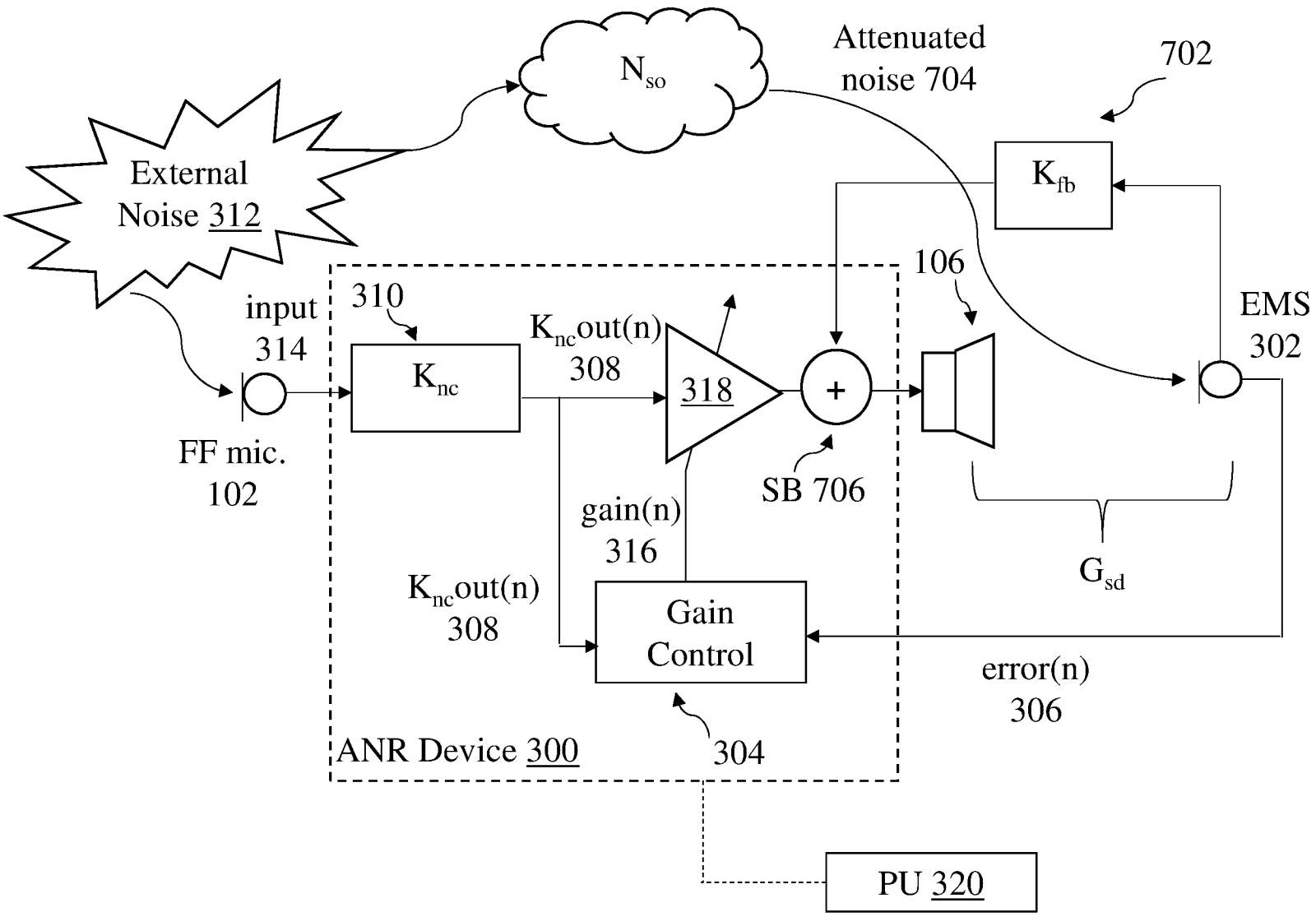
FIG. 7 is a block diagram of portions of an ANR device in a headphone according to various implementations.

FIG. 7 illustrates the signal flow topology of FIG. 3, with the addition of a feedback filter (controller) 702 for modifying the output to the driver 106 based on an detected attenuated noise signal 704 (i.e., external noise 312 processed through an attenuation filter $N_{so}$). In some cases, the attenuated external noise 704 is detected at the EMS 302 (e.g., feedback microphone or error microphone). In other cases, the external noise 312 and/or the attenuated noise signal 704 is detected by a separate sensor that is not part of the feedback (FB) loop. FIG. 7 also illustrates an implementation including a discrete summing block (SB) 706 between the gain control element 318 and the transducer 106. Feedback filter 702 is present in the feedback signal flow topology, similar to feedback path 114 shown in FIG. 2. In certain implementations, the presence of feedback filter 702 may require changes to the estimator filter 510 (FIG. 5) to estimate the feedforward path contribution with an active feedback system. In certain cases, the summing block 706 is configured to sum the adjusted anti-noise signal 308 (after applying gain 316) with the output from the feedback filter 702 prior to outputting the signal to the transducer 106.

In any case, relative to conventional devices, the ANR devices shown and described herein are configured to improve noise reduction for a group of users (e.g., across varying fits) with the use of fixed filter coefficients. These ANR devices can efficiently respond to changes in ambient noise conditions while conserving power and processing resources.

As noted herein the ANR device 300 can include one or more circuit components for performing processes according to various implementations. In certain cases, the ANR device 300 includes a control circuit coupled with a processor and/or logic engine for adjusting a gain on one or more signals for producing an acoustic output. In some particular cases, a control circuit is contained in one or both earpieces in a headset, and receive commands from a logic engine for performing functions described herein. In additional cases, a logic engine is located remotely relative to earpieces in the ANR headphone, e.g., in a connected smart devices such as a smart phone, smart watch, wearable smart device, etc., or in a cloud-based logic engine that is accessible via communications components at the ANR headpiece (not shown).

The controller(s) in the ANR device 300 can execute instructions (e.g., software), including instructions stored in a memory or in a secondary storage device (e.g., a mass storage device). The controller(s) in the ANR device 300 may be implemented as a chipset of chips that include separate and multiple analog and digital processors. The controllers in ANR device 300 may provide, for example, for coordination of other components in the ANR headpiece, such as control of user interfaces, applications run by additional electronics in the ANR headpiece, and network communication by the ANR headpiece. The controller in the ANR device 300 may manage communication with a user through a connected display and/or a conventional user input interface.

In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

The term "approximately" as used with respect to values herein can allot for a nominal variation from absolute values, e.g., of several percent or less. Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Where the term "comprising" is used in the present description and claims, it does not exclude other elements or operations. The term "based on" (as in "A is based on B") is used to indicate any of its ordinary meanings, including the cases (i) "based on at least" (e.g., "A is based on at least B") and, if appropriate in the particular context, (ii) "equal to" (e.g., "A is equal to B"). Similarly, the term "in response to" is used to indicate any of its ordinary meanings, including "in response to at least."

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Any incorporation by reference of a portion of a document shall also be understood to incorporate definitions of terms or variables that are referenced within the portion, where such definitions appear elsewhere in the document, as well as any figures referenced in the incorporated portion.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Elements of figures are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawings.

Other embodiments not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

We claim:

1. A method, comprising:

receiving an input signal representing audio captured by a feedforward microphone of an active noise reduction (ANR) headphone;

receiving an error signal representing audio captured by an error measurement sensor;

generating an anti-noise signal configured to reduce a noise signal over a frequency range; and applying a gain to at least one of the input signal or the anti-noise signal over the frequency range based on the error signal, wherein the gain is calculated by:

filtering the anti-noise signal over the frequency range to generate a filtered feedforward signal, and filtering the error signal over the frequency range to generate a filtered error signal;

estimating a feedforward path contribution to the error signal; and determining the gain based on a correlation between the filtered error signal and the filtered feedforward signal with the assigned feedforward path contribution to the error signal.

2. The method of claim 1, wherein estimating the feedforward path contribution to the error signal is performed with an estimator filter prior to determining the gain.

3. The method of claim 2, wherein the estimate of the feedforward path contribution to the error signal is calculated using an estimated system transfer function ($G_{sd}$) applied to the anti-noise signal, wherein the anti-noise signal is generated by an ANR filter.

4. The method of claim 3, wherein the estimated system transfer function ($G_{sd}$) is an estimate based on measured transfer function components.

5. The method of claim 1, wherein the filtering is performed using a bandpass filter.

6. The method of claim 5, wherein the bandpass filter is applied across a frequency range that is predetermined and is equal to approximately 50 Hertz (Hz) to approximately 800 Hz.

7. The method of claim 6, wherein a phase of the anti-noise signal and the error signal varies by less than a threshold.

8. The method of claim 1, further comprising modifying the gain based on at least one of: an overload control adjustment, a self-voice detection adjustment, a music playback mode adjustment, an aware mode adjustment, or a communication mode adjustment.

9. The method of claim 1, wherein the anti-noise signal is generated by an ANR filter, wherein the ANR filter has a fixed set of filter coefficients for generating the anti-noise signal.

10. The method of claim 9, wherein the ANR filter has a voltage limit for generating the anti-noise signal.

11. The method of claim 1, wherein the gain has an upper limit based on an expected value of the input signal or the error signal.

12. The method of claim 1, further comprising:

in response to the determined gain exceeding a threshold attributed to a fit of the ANR headphone, sending an indicator to a user of the ANR headphone to adjust the fit.

13. The method of claim 1, further comprising:

in response to the determined gain deviating from a threshold attributed to on-head usage of the ANR headphone, at least one of: powering down the ANR headphone or switching the ANR headphone to a standby mode.

14. The method of claim 1, wherein the gain is calculated by a gain control block, wherein the gain control block is configured to calculate the gain over only the frequency range.

15. The method of claim 14, wherein the gain control block down-samples the anti-noise signal and the error signal to mitigate power usage in the ANR headphone.

16. The method of claim 1, wherein the error measurement sensor comprises a feedback microphone at the ANR headphone, the method further comprising:

adjusting, at the ANR filter, the gain based on a feedback signal detected by the feedback microphone.

17. The method of claim 1, wherein the ANR headphone is an in-ear audio device or an around-ear audio device.

18. An active noise reduction (ANR) device, comprising:

a feedforward input for receiving an input signal representing audio captured by a feedforward microphone of an active noise reduction (ANR) headphone;

a gain control block for receiving an error signal representing audio captured by an error measurement sensor; and an ANR filter for generating an anti-noise signal configured to reduce a noise signal over a frequency range, wherein the gain control block is configured to apply a gain to at least one of the input signal or the anti-noise signal over the frequency range based on the error signal, wherein the gain control block calculates the gain by:

applying a bandpass filter to the anti-noise signal over the frequency range to generate a filtered feedforward signal, and applying the bandpass filter to the error signal over the frequency range to generate a filtered error signal;

estimating a feedforward path contribution to the error signal; and determining the gain based on a correlation between the filtered error signal and the filtered feedforward signal with the assigned feedforward path contribution to the error signal.

19. The ANR device of claim 18, further comprising:

an estimator filter configured to estimate the feedforward path contribution to the error signal prior to determining the gain, wherein the estimate of the feedforward path contribution to the error signal is calculated using an estimated system transfer function ($G_{sd}$) applied to the anti-noise signal generated by the ANR filter, wherein the magnitude of the system transfer function ($G_{sd}$) is an estimate based on measured transfer function components.

20. The ANR device of claim 18, wherein the gain control block is configured to calculate the gain over only the frequency range, and wherein the gain control block downsamples the anti-noise signal and the error signal to mitigate power usage.

21. The ANR device of claim 18, further comprising a processor coupled with the ANR filter, the processor configured to perform at least one of:

a) in response to the determined gain exceeding a threshold attributed to a fit of the ANR headphone, sending an indicator to a user of the ANR headphone to adjust the fit, or b) in response to the determined gain deviating from a threshold attributed to on-head usage of the ANR headphone, at least one of: powering down the ANR headphone or switching the ANR headphone to a standby mode.

* * * * *